US005908070A

United States Patent [19]

Kato et al.

[11] Patent Number: 5,908,070

[45] Date of Patent: Jun. 1, 1999

[54] HEAT EXCHANGER

[75] Inventors: Soichi Kato; Shoji Akiyama, both of Konan, Japan

[73] Assignee: Zexel Corporation, Tokyo, Japan

[21] Appl. No.: 08/868,890

[22] Filed: Jun. 4, 1997

[30] Foreign Application Priority Data

Jun. 6, 1996 [JP] Japan ..... 8-166828

[51] Int. Cl.[6] ..... F28F 9/04

[52] U.S. Cl. ..... 165/173; 165/153

[58] Field of Search ..... 165/170, 177, 165/183, 153, 173

[56] References Cited

U.S. PATENT DOCUMENTS 5,172,476 12/1992 Joshi ..... 29/890.053
5,186,250 2/1993 Ouchi et al. ..... 165/177
5,441,105 8/1995 Brummett et al. ..... 165/170 X
5,689,881 11/1997 Kato ..... 165/177 X

*Primary Examiner*—Leonard Leo
*Attorney, Agent, or Firm*—Wenderoth, Lind & Ponack, L.L.P.

[57] ABSTRACT

In order to achieve an improvement in productivity and a reduction in production costs, tubes are formed using brazing sheet while eliminating the problems normally associated with forming tubes from a brazing sheet. In each of the tube elements formed from a brazing sheet, at least one ridge projects out from a surface that is in contact with a fin toward the other surface that is in contact with a fin at the opposite side is formed, thereby achieving an improvement in the pressure withstand performance of the tube elements and in the heat exchanging rate. In addition, flat portions where no ridges are formed are provided at the two ends of each tube element to facilitate the work of mounting the tube elements. Moreover, the distance between the header pipes and the ridge end portions is set within a range of 2 mm to 10 mm, in order to ensure good balance between the pressure withstand performance and effective brazing.

2 Claims, 5 Drawing Sheets

HEAT EXCHANGER

BACKGROUND OF THE INVENTION

1. Field of the Invention

The present invention relates to a heat exchanger that is employed in an air conditioning system for vehicles and the like and constitutes a portion of the cooling cycle.

2. Description of the Related Art

A prior art heat exchanger, which is disclosed in Japanese Unexamined Patent Publication No. H7-190661, is constituted of tubes formed through extrusion molding and fins provided between the tubes and a pair of headers. This heat exchanger is employed as an evaporator or as a dual purpose type heat exchanger that can be switched so as to function as an evaporator or a condenser. Also, in order to efficiently discharge condensation adhering to the surfaces of the tubes when employed as an evaporator, an indented drain portion is formed on the surface of each tube. In addition, the drain portions are not formed at the ends of the tubes to ensure that the tubes can be easily inserted into the headers. While it is desirable to form the tubes with a small thickness in order to improve their heat communicating performance, there is a likelihood that the pressure withstand performance will be reduced if the tubes are formed too thin. To deal with this, a plurality of partitioning walls are formed inside the tubes to improve the pressure withstand performance of the tubes.

However, in recent years, in order to achieve an improvement in the productivity and a reduction in production costs, tubes are often formed using brazing sheet instead of forming the tubes through extrusion molding. As a result, in order to improve the pressure withstand performance of the tubes that are formed in a flattened pipe shape with brazing sheet, inner fins are inserted and brazed within the tubes.

SUMMARY OF THE INVENTION

An object of the present invention is to provide a heat exchanger with tubes formed with brazing sheet in order to achieve an improvement in productivity and a reduction in production costs, which eliminates the problems normally associated with forming tubes with brazing sheet.

Accordingly, the heat exchanger, according to the present invention, comprises a pair of header pipes at which an inflow port and an outflow port for heat exchanging medium are formed, and a plurality of tube elements that communicate between the header pipes and fins that are provided between the plurality of tube elements. The tube elements are formed in an integrated manner using one brazing sheet, and at least one ridge is formed at each of the two side surfaces of each tube element where it comes in contact with the fins, projecting out toward the other side surface with a flat portion extending over a specific distance at each end. The distance between the header pipes and the ridge end portions that is formed when the tube elements are inserted into the header pipes is within the range of 2 mm to 10 mm.

Thus, according to the present invention, since a flat portion is formed at each end of the tube elements formed from a brazing sheet, it is possible to simplify the shape of the insertion portions of the tube elements. Also, since the shape of the insertion holes formed at the header pipes for mounting the tube elements can be simplified in a similar manner, it is possible to achieve an improvement in the process of inserting the tube elements into the header pipes. Furthermore, since the ridges that project out from the individual side surfaces can be formed as an integrated part, the pressure withstand performance of the tube elements is improved, thus achieving the object described above.

In addition, with the ridges formed so as to project outwardly the contact surface area where the coolant comes in contact, i.e., the area over which the coolant and the air come in contact with each other via the tube elements, can be increased, thus achieving an improvement in the rate of heat exchange of the coolant. Moreover, by setting the distance between the header pipes and the ridge end portions within a range of 2 mm through 10 mm, the flat portions where no ridges are provided can be prevented from becoming deformed by the pressure of the coolant flow. Also, and since the brazing material is prevented from flowing into the ridges, which tends to occur if the ridges are provided too close to the header pipes, a good bonding state can be maintained between the tube elements and the header pipes. It is to be noted that the range of the distance between the header pipes and the ridge end portions over which the quantity of deformation of the heat exchanger in the direction of lamination remains at 0 mm with a test coolant-pressure of 60 kg/cm$^2$G, is 0 mm through 5 mm. The maximum value for this distance, at which the quantity of deformation remains at 2 mm, which constitutes the allowable tolerance, is 10 mm. In addition, the allowable range over which the brazing material is allowed to run to the ridge end portions is 2 mm. Thus, an optimal range of 2 mm to 10 mm is set as the distance.

Also, according to the present invention, the tube elements are formed in an integrated manner from one brazing sheet. Since the tube elements can be formed continuously from one brazing sheet, productivity is improved. Moreover, the brazed portion at one of the side surfaces of each tube element is no longer required and, therefore, an improvement in the pressure withstand performance of the tube element is achieved.

Alternatively, the tube elements may be formed from two brazing sheets, each constituting one of the two side surfaces of each tube element. In that case, since the process in which the brazing sheet is bent is not required, the formation of the individual side surfaces is facilitated, achieving an advantage in that the production line can be shortened.

Moreover, the ridges formed at the individual side surfaces are formed at positions that are offset from each other by a specific distance and the apex of the ridge at each side surface is bonded to the other side surface. With this, since the ridge projecting out from one side surface and the ridge projecting out from the other side surface are made to partition the space within the tube element alternately, the bending operation is facilitated compared to a case in which the end portions of the ridges are placed in contact with each other, thus achieving an improvement in work efficiency.

Alternatively, the ridges formed at the individual side surfaces may be formed at positions at which they face opposite each other with the apexes of the individual ridges bonded to each other. In this case, particularly if the tube elements are to be formed from two brazing sheets, they can be formed simply by bonding identical parts face-to-face, thereby preventing a reduction in the degree of work efficiency that would otherwise occur due to considerations of positional alignment.

Alternatively, in the heat exchanger according to the present invention, which comprises a pair of header pipes at which an inflow port and an outflow port for heat exchanging medium are formed, and a plurality of tube elements communicating between the pair of header pipes and fins that are provided between the plurality of tube elements, the tube elements are formed by:

(a) forming a plurality of ridges which project out continuously in the lengthwise direction of a brazing sheet;

(b) forming flat portions by pressing the ridges at a specific distance;

(c) gradually bending the brazing sheet at a central portion in the direction of the minor axis that is perpendicular to the lengthwise direction of the sheet as a boundary to form a flattened pipe shape and placing the plurality of ridges in contact with the opposite surfaces to divide the space inside the tube element; and (d) sequentially cutting a central portion in the lengthwise direction at the flat portions. Since this method facilitates production of tube elements structured as described above, the object described above is achieved.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the embodiments of the present invention in reference to the drawings.

Figure 1:
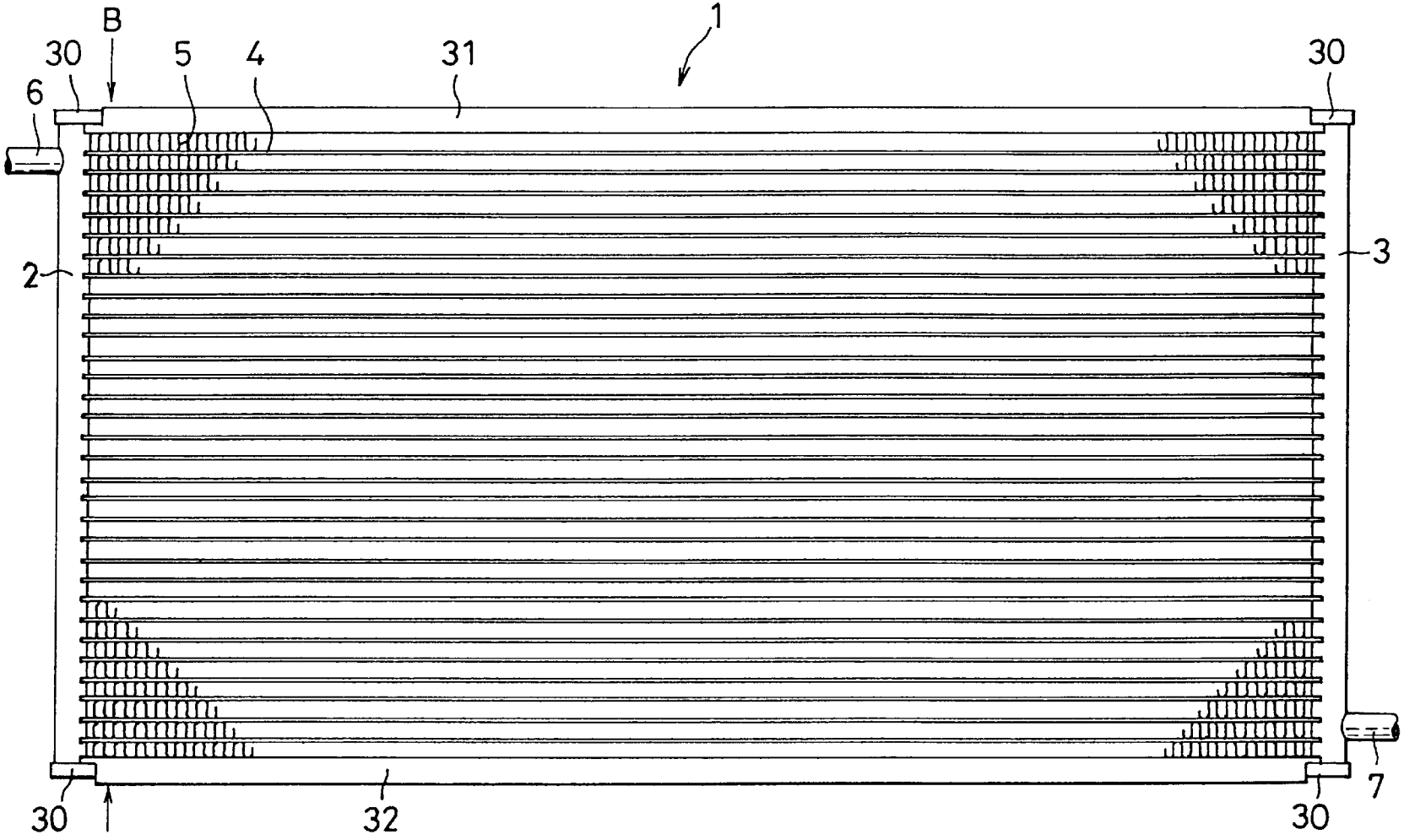
FIG. 1 is a front view of the heat exchanger in an embodiment of the present invention.

A heat exchanger 1 shown in FIG. 1 may be used, for instance, as a condenser that constitutes a portion of the cooling cycle in an air conditioning system for vehicles. The heat exchanger 1 comprises a pair of header pipes 2 and 3, a plurality of tube elements 4 that communicate between the pair of header pipes 2 and 3 and corrugated fins 5 that are provided between the tube elements 4. In addition, a coolant intake pipe 6 and a coolant outlet pipe 7 are provided at the pair of header pipes 2 and 3.

In this embodiment, the heat exchanger 1 with a plurality of levels (an odd number of levels) of coolant flow paths is constituted by providing the coolant intake pipe 6 at the upper portion of one of the header pipes, i.e., the header pipe 2, providing the coolant outlet pipe 7 at the lower portion of the other header pipe 3 and partitioning specific portions of the header pipes 2 and 3 with a partitioning plate (not shown). It is to be noted that in FIG. 1, reference number 30 indicates lids that each blocks off an end portion of the header pipe 2 or 3 and that reference numbers 31 and 32 indicate end plates that hold the two ends of the tube elements 4 and the fins 5 in the direction of the lamination.

Figure 2:
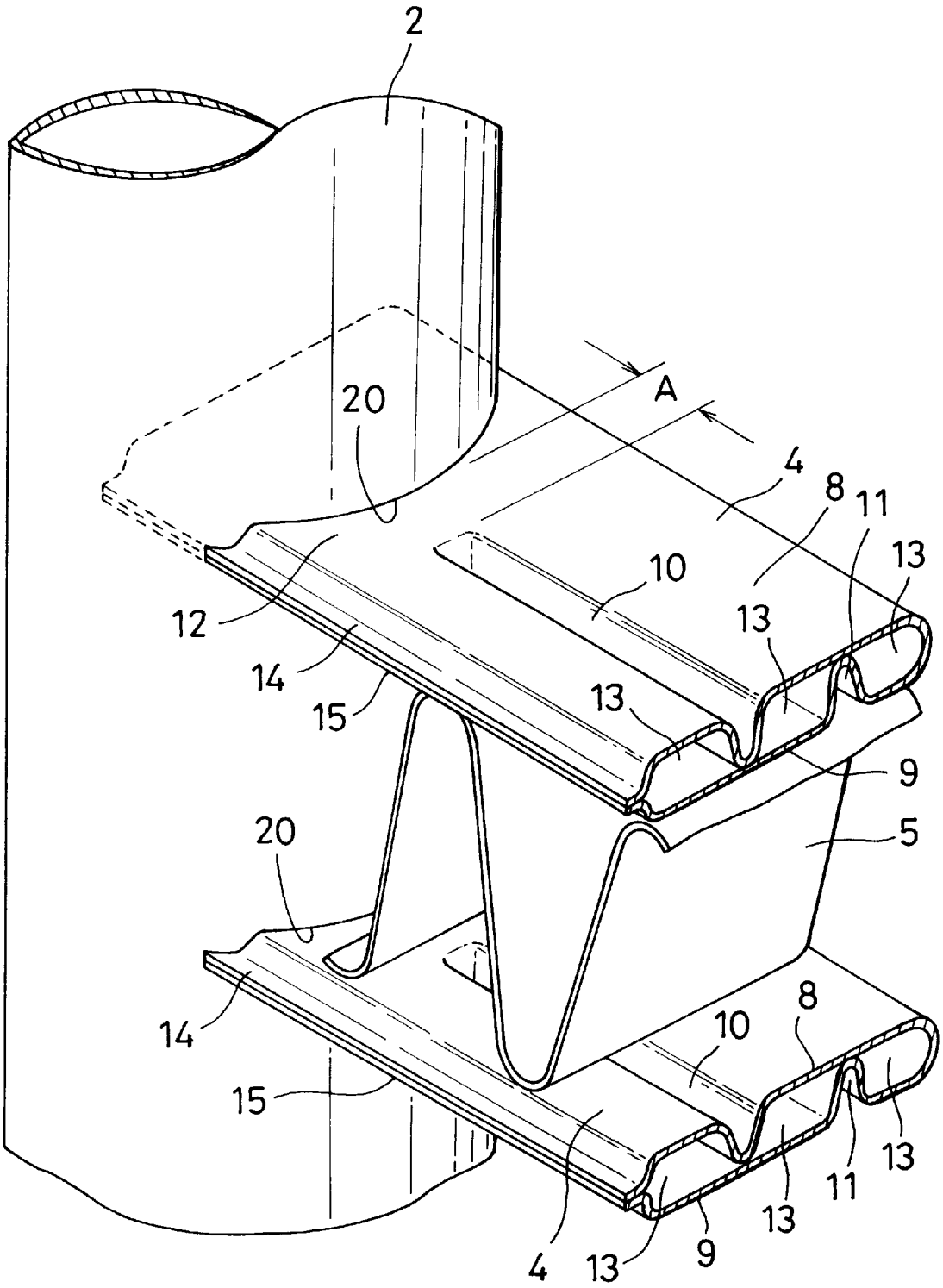
FIG. 2 is a partially enlarged perspective view illustrating the relationship between the header pipes and the tube elements.
Figure 3:
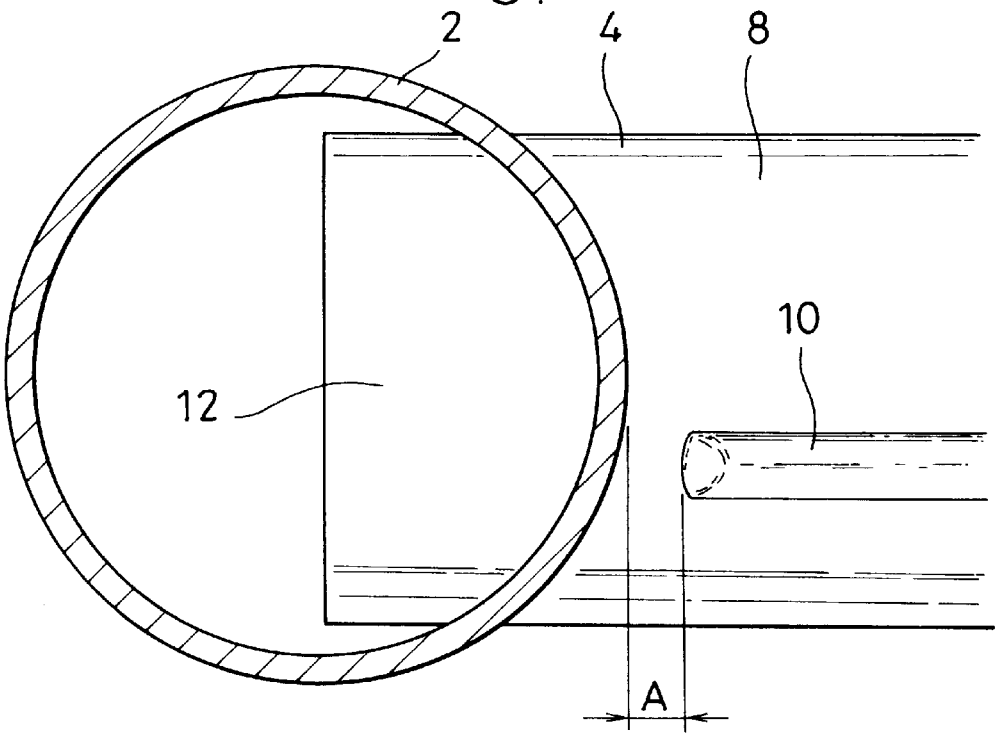
FIG. 3 is a partially enlarged cross section illustrating the relationship between the tube elements.

In the heat exchanger 1, structured as described above, the tube elements 4 in the first embodiment are formed in a flattened pipe shape from a brazing sheet, as shown in FIGS. 2 and 3, with ridges 10 and 11 extending in the direction of the length of the tube elements 4 formed at the two side surfaces 8 and 9 of each tube element that are in contact with the fins 5 and face opposite each other. In addition, the ridge 10 is formed to project out from the side surface 8 toward the side surface 9 with its front end in contact with and brazed to the inside of the side surface 9, whereas the ridge 11 is formed to project out from the side surface 9 toward the side surface 8 with its front end in contact with and brazed to the inside of the side surface 8. It is to be noted that in this embodiment, the ridge 10 and the ridge 11 are provided at positions that are offset from each other by a specific distance.

With this, the space inside each tube element 4 is divided by the ridges 10 and 11, forming a plurality of coolant flow paths 13, i.e., 3 coolant flow paths 13 in this embodiment. It is to be noted that reference numbers 14 and 15 in FIG. 2 indicate brazing margins for forming the bonding side portions of the tube elements 4.

Furthermore, with the ridges 10 and 11 formed and their end portions brazed and secured to the opposite side surfaces, the pressure withstand performance of the tube elements 4 is improved. In addition, since the side surfaces of the ridges 10 and 11 contribute to and increase the area over which the coolant flowing through the coolant flow paths 13 comes in contact with the tube elements 4, and also increase the area over which the surfaces of the tube elements 4 come in contact with the air, an improvement in the heat exchanging efficiency of the coolant is achieved.

Note that, since, if the ridges 10 and 11 are formed reaching all the way to the end portions of the tube elements 4, the shape of the insertion holes for mounting the tube elements, which are formed at the header pipes 2 and 3, become complicated, flat portions 12 where the ridges 10 and 11 are not formed over a specific range are provided at the two end portions of each of the tube elements in the lengthwise direction in the present invention. This makes it possible to simplify the shape of the insertion holes 20 formed at the header pipes 2 and 3. Moreover, since both ends of the tube elements 4 can be formed in a flattened pipe shape, an improvement in work efficiency is achieved in the process through which the tube elements 4 are inserted into the header pipes 2 and 3.

Figure 4:
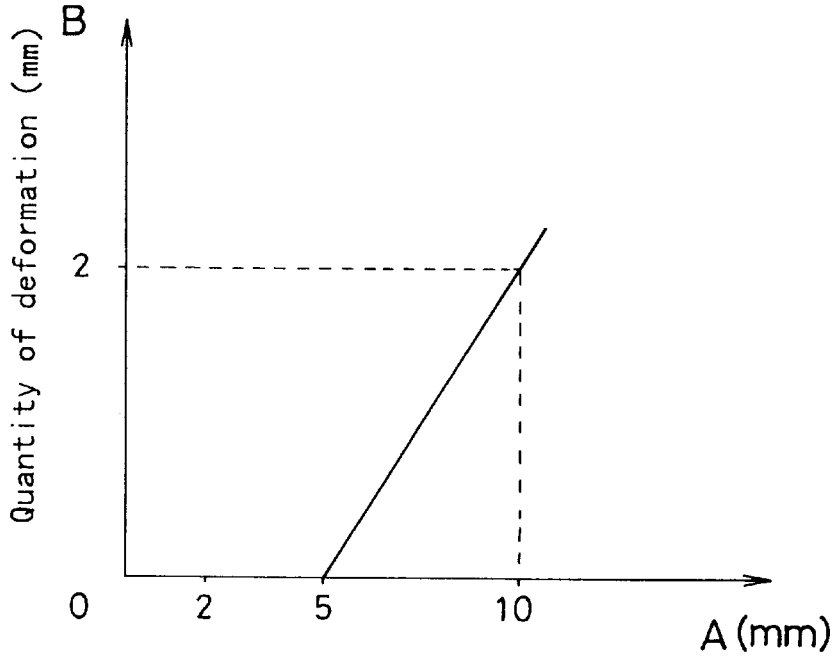
FIG. 4 is a graph showing the results of a test to determine the relationship between the distance A between the header pipes and the ridges and the quantity of deformation B of the heat exchanger in the direction of lamination when a test pressure is applied.

In addition, the characteristics shown in FIG. 4 were observed through testing with respect to the relationship between the distance A between the end portions of the header pipes 2 and 3 and the end portions of the ridges 10 and 11 and the quantity of distortion B caused in the heat exchanger 1. These characteristics represent the relationship between the distance and the quantity of distortion in the direction of the lamination of the heat exchanger and, in particular, the quantity of distortion B in the flat portions 12, when a coolant at a test pressure of 60 $kg/cm^2G$ was supplied through the heat exchanger. The pressure of the coolant flowing under normal circumstances is 15~20 $kg/cm^2G$ and the range of the distance A over which the quantity of distortion B of the heat exchanger remains at 0 mm under the test pressure was 0 mm through 5 mm. Also, the range of the distance A with the quantity of distortion B set at 2 mm as the maximum allowable tolerance, is up to 10 mm.

Moreover, if the distance A is set too small, the end portions of the ridges 10 and 11 will be too close to the area where the header pipes 2 and 3 are brazed to the tube elements 4, posing a problem of the brazing material in the bonding area flowing into the ridges 10 and 11 leaving insufficient quantity of brazing material in the bonding area resulting in defective bonding. Thus, it is desirable to allow 2 mm or more for the distance A to ensure that such running of the brazing material is prevented. Consequently, an optimal range of 2 mm through 10 mm is set for the distance A.

Figure 5:
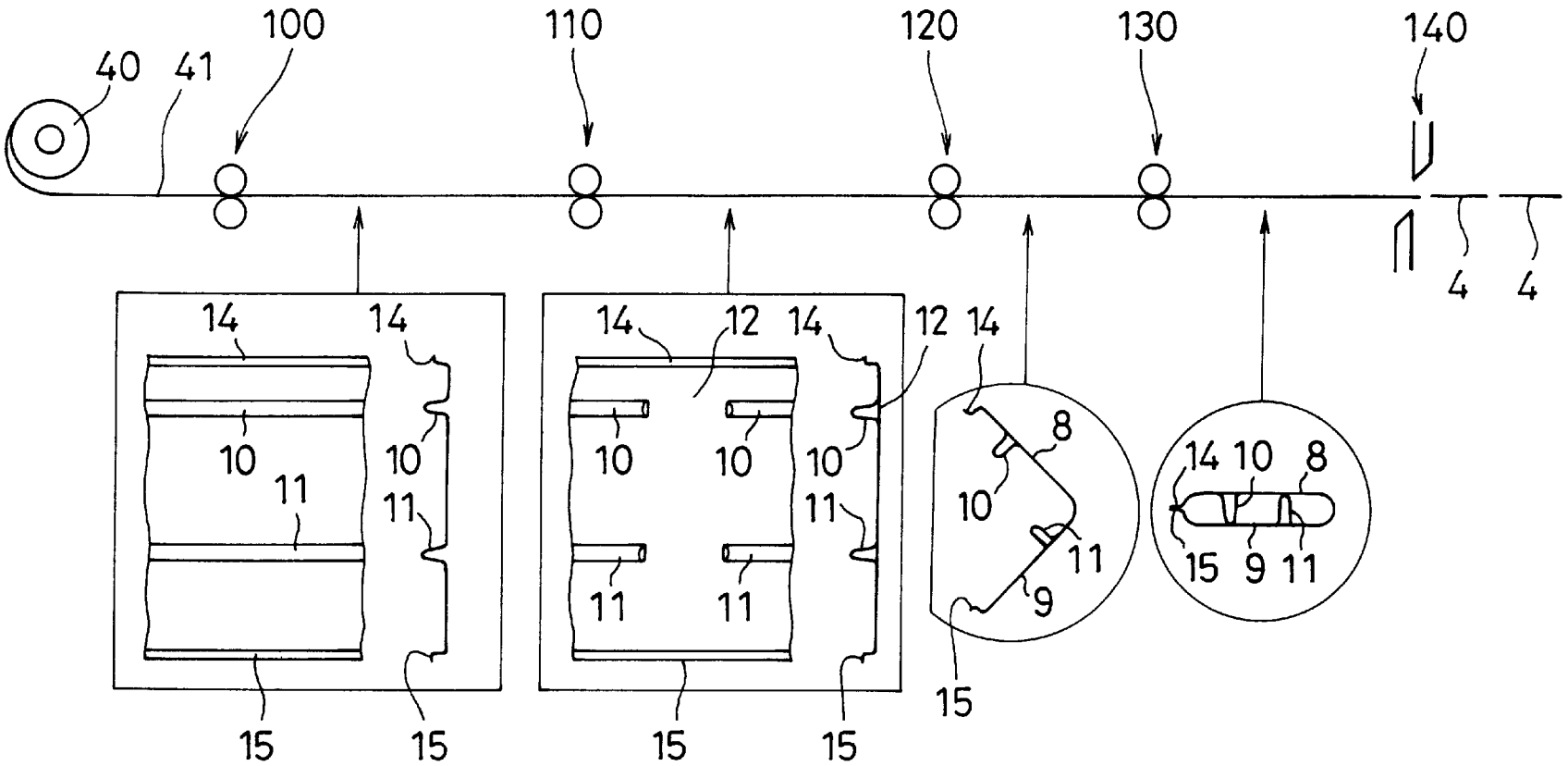
FIG. 5 illustrates the manufacturing process of the tube elements in the first embodiment.

Methods for forming the tube elements 1 that are structured as described above include, for instance, the method shown in FIG. 5. A brazing sheet 41, which is wound around a drum 40, is continuously fed out from the drum 40 and when it passes through a first roller portion 100, brazing margins 14 and 15 and the ridges 10 and 11 are continuously formed in the direction in which the brazing sheet 41 is fed out (the lengthwise direction). Next, as it passes through a second roller portion 110, the ridges 10 and 11 are pressed out over a specific distance in the direction of feed to form the flat portions 12.

Then, over the distance running from a third roller portion 120 through a fourth roller portion 130, the sheet is gradually bent over, to be formed into a flattened pipe shape, and it is then cut at a cutting portion 140 to form the tube elements 4. It is to be noted that after this, the tube elements 4 are inserted into the pair of header pipes 2 and 3, laminated alternately with the fins 5 between the pair of header pipes 2 and 3, and clamped together with the end plates 31 and 32 in a jig as a temporary assembly and then brazed in a furnace.

Figure 6:
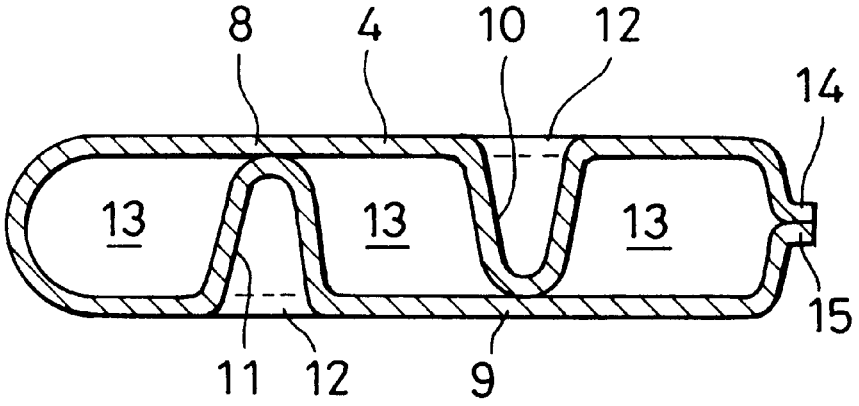
FIG. 6 is a cross section of the tube elements in the first embodiment.

Through this process, as shown in FIG. 6, the brazing margins 14 and 15 of the tube elements 4 are bonded and a plurality of coolant flow paths 13 are constituted by brazing the areas between the front end portions of the ridges 10 and 11 and the surfaces that come in contact with the front end portions, completing the formation of the tube elements 4, and in addition, the areas between the insertion holes 20 formed at the header pipes 2 and 3 to mount the tube elements and the tube elements 4 themselves are also brazed together to complete mounting of the tube elements 4 at the header pipes 2 and 3, thereby completing the formation of the heat exchanger 1.

Figure 7:
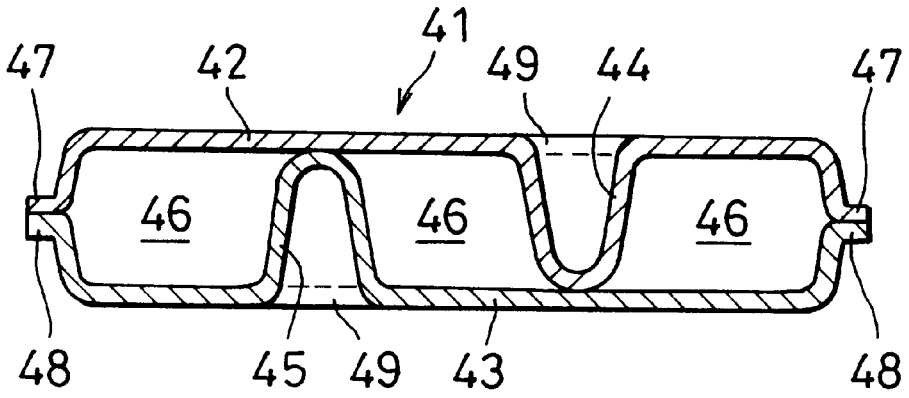
FIG. 7 is a cross section of the tube elements in the second embodiment.

A tube element 41 in the second embodiment shown in FIG. 7 is constituted with a first plate 42, which is to form a side surface at one side, and a second plate 43, which is to form a side surface at the other side. In addition, at the first plate 42, brazing margins 47 are formed at the two side surfaces along the lengthwise direction, a ridge 44 projecting out toward the second plate is formed and flat portions 49 are formed at the two ends in the lengthwise direction. Likewise, at the second plate 43, brazing margins 48 are formed at the two side surfaces along the lengthwise direction, a ridge 45 projecting out toward the first plate is formed and flat portions 49 are formed at the two ends in the lengthwise direction. Thus, a plurality of coolant flow paths 46 are formed inside the tube element 41. It is to be noted that the ridge 44 and the ridge 45 are formed at positions that are offset from each other by a specific distance and the apexes of these ridges are placed in contact with and brazed to the internal surfaces of the plates facing opposite. With the tube elements 41 in the second embodiment, while the first plate 42 and the second plate 43 are formed as identical parts, directionality is generated in the parts when they are bonded face-to-face.

As explained above, while, since the tube elements 41 in the second embodiment are formed of the first plate 42 and the second plate 43 which, in turn, are formed from two brazing sheet, there is a larger brazing area in comparison to the tube elements 4 in the first embodiment, the work process executed by the third roller portion and the fourth roller portion, i.e., the so-called fixing of the bend, can be eliminated in the manufacturing process shown in FIG. 5, simplifying the formation of the tube elements.

Figure 8:
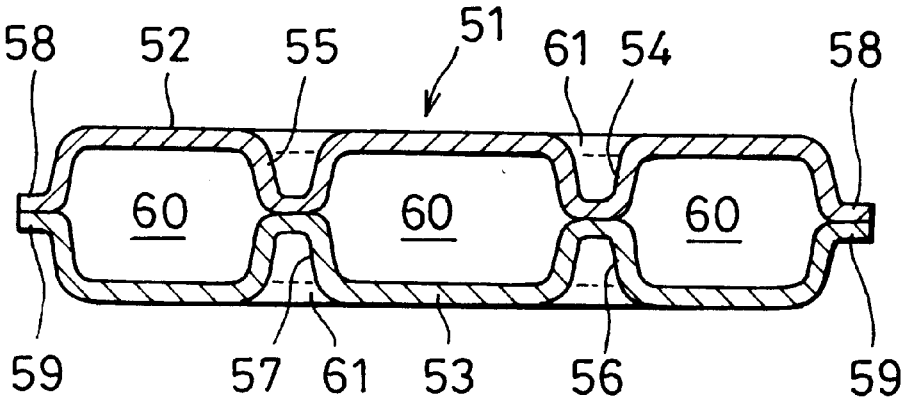
FIG. 8 is a cross section of the tube elements in the third embodiment.

In addition, the tube element 51 in the third embodiment shown in FIG. 8, is constituted with a first plate 52, which is to form a side surface at one side and a second plate 53 which is to form a side surface at the other side. In addition, at the first plate 52 brazing margins 58 are formed at the two side surfaces along the lengthwise direction, ridges 54 and 55 projecting out toward the second plate are formed and flat portions 61 are formed at the two ends in the lengthwise direction. Likewise, at the second plate 53, brazing margins 59 are formed at the two side surfaces along the lengthwise direction, ridges 56 and 57 projecting out toward the first plate are formed and flat portions 61 are formed at the two ends in the lengthwise direction. It is to be noted that the ridge 54 in the first plate 52 is bonded face-to-face with the ridge 56 of the second plate 53, whereas the ridge 55 of the first plate 52 is bonded face-to-face with the ridges 57 of the second plate 53. Thus, a plurality of coolant flow paths 60 are formed inside the tube element 51.

Consequently, the tube elements 51 in the third embodiment can be formed simply by bonding face-to-face identical parts, and in particular, any reduction in work efficiency that would otherwise occur due to considerations of positional alignment can be prevented.

As has been explained, according to the present invention, in each of the tube elements formed from brazing sheet, at least one ridge projecting out from a surface that comes in contact with a fin at one side and toward a surface that comes in contact with a fin at the other side is formed to achieve an improvement in the pressure withstand performance and the heat exchange rate of the tube elements, and by forming flat portions where no ridges are formed at the two ends of the tube elements to achieve easier assembly of the tube elements and the header pipes. Furthermore, by setting the distance between the header pipes and the ridges within a specific range, reliability in regard to strength can be improved and, at the same time, an improvement in the brazing work and in assembly are achieved. Moreover, an overall improvement in productivity and a reduction in manufacturing costs are achieved.

What is claimed is:

1. A heat exchanger comprising:

a pair of header pipes in which an inflow port and an outflow port for heat exchanging medium are formed;

a plurality of tube elements, communicating between said pair of said header pipes, each of said tube elements has a first outer side surface, a second outer side surface, a first inner side surface and a second inner side surface; and fins provided between said tube elements;

wherein each of said tube elements comprises:

a brazing sheet folded in a direction of a minor axis which runs perpendicular to a longitudinal direction of said brazing sheet;

a first ridge projecting from said first inner side surface toward said second inner side surface;

a second ridge, laterally offset from said first ridge, projecting from said second inner side surface toward said first inner side surface;

a first flat portion inserted in one of said header pipes and provided over a predetermined range at a first end of said tube element relative to the longitudinal direction of said tube element; and a second flat portion inserted in the other of said header pipes and provided over a predetermined range at a second end of said tube element relative to the longitudinal direction of said tube element;

wherein a distance between one of said header pipes and a first end of each of said first and second ridges, nearest to said one header pipe, is within a range of 2 mm–10 mm.

2. A heat exchanger as claimed in claim 1, the heat exchanger being manufactured by a method comprising:

transferring the brazing sheet in a first direction;

forming a pair of continuous projecting ridges in said brazing sheet along said first direction, said ridges being spaced at a specific distance along the a minor axial direction which is perpendicular to the first direction;

pressing out said ridges over specific distances in order to form said flat portions;

gradually folding said brazing sheet along a central longitudinal portion thereof so as to form a flattened pipe shape; and sequentially cutting said folded brazing sheet at an approximately middle portion of each of the flat portions formed in said brazing sheet.

* * * * *